US011295692B2

(12) United States Patent
Zhao

(10) Patent No.: US 11,295,692 B2
(45) Date of Patent: Apr. 5, 2022

(54) DISPLAY DEVICE AND DRIVING METHOD

(71) Applicants: HKC Corporation Limited, Shenzhen (CN); Chongqing HKC Optoelectronics Technology Co., Ltd., Chongqing (CN)

(72) Inventor: Wenqin Zhao, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/042,813

(22) PCT Filed: Nov. 26, 2018

(86) PCT No.: PCT/CN2018/117431

§ 371 (c)(1),
(2) Date: Sep. 28, 2020

(87) PCT Pub. No.: WO2020/052080

PCT Pub. Date: Mar. 19, 2020

(65) Prior Publication Data

US 2021/0020136 A1 Jan. 21, 2021

(30) Foreign Application Priority Data

Sep. 10, 2018 (CN) ..... 201811051180.0

(51) Int. Cl.
*G09G 3/36* (2006.01)

(52) U.S. Cl.
CPC ..... *G09G 3/3685* (2013.01); *G09G 2310/08* (2013.01); *G09G 2330/06* (2013.01); *G09G 2370/08* (2013.01)

(58) Field of Classification Search
CPC combination set(s) only.
See application file for complete search history.

(56) References Cited

U.S. PATENT DOCUMENTS

2010/0176749 A1* 7/2010 Ku ..... G09G 3/20 315/360
2015/0154943 A1* 6/2015 Lee ..... G09G 5/18 345/204

(Continued)

FOREIGN PATENT DOCUMENTS

CN 101582246 A 11/2009
CN 201374641 Y 12/2009

(Continued)

OTHER PUBLICATIONS

Office Action dated Oct. 18, 2019, issued in corresponding Chinese Application No. 201811051180.0, filed Sep. 10, 2018, 9 pages.

(Continued)

*Primary Examiner* — Md Saiful A Siddiqui

(57) ABSTRACT

A display device and a driving method, comprising: a time sequence controller generating a time sequence control verification signal on the basis of a display data signal; a high-speed interface of the time sequence controller transmitting the display data signal to a driver, and a low-speed interface of the time sequence controller transmitting a time sequence control verification signal to the driver; the driver generating a source driving verification signal on the basis of the display data signal; the driver comparing the source driving verification signal to the time sequence control verification signal; and on the basis of the comparison result, the driver triggering the time sequence controller to adjust the display data signal.

18 Claims, 5 Drawing Sheets

(56) References Cited

U.S. PATENT DOCUMENTS

| | | | | |
|---|---|---|---|---|
| 2016/0365071 | A1 | 12/2016 | Lim et al. | |
| 2018/0061308 | A1* | 3/2018 | Bae | G09G 5/377 |
| 2018/0308440 | A1* | 10/2018 | Huang | G09G 3/3648 |

FOREIGN PATENT DOCUMENTS

| | | | |
|---|---|---|---|
| CN | 101635127 | A | 1/2010 |
| CN | 101833924 | A | 9/2010 |
| CN | 103489392 | A | 1/2014 |
| CN | 106098017 | A | 11/2016 |
| CN | 106205535 | A | 12/2016 |
| CN | 107408370 | A | 11/2017 |
| CN | 107680554 | A | 2/2018 |
| CN | 108156396 | A | 6/2018 |
| JP | 2007212433 | A | 8/2007 |
| KR | 20050090644 | A | 9/2005 |

OTHER PUBLICATIONS

International Search Report dated Jun. 14, 2019, issued in corresponding International Application No. PCT/CN2018/117431, filed Nov. 26, 2018, 2 pages.

* cited by examiner

DISPLAY DEVICE AND DRIVING METHOD

CROSS REFERENCE TO RELATED APPLICATIONS

This application claims priority to Chinese Patent Application No. 2018110511800, entitled "DISPLAY DEVICE AND DRIVING METHOD", filed on Sep. 10, 2018, the entire content of which is incorporated herein in its entirety.

TECHNICAL FIELD

The present disclosure relates to the field of liquid crystal display technology, and more particularly, to a display device and a driving method.

BACKGROUND

With the development of liquid crystal display technology, liquid crystal display has been widely approved by the market owing to their advantages such as low power consumption and ultrathin configuration, etc. However, as people are increasingly aware of importance of environmental protection, requirements for various manufacturers on electromagnetic interference (EMI) are getting increasingly high. EMI mainly refers to electromagnetic interference signals emitted to surrounding environment as a result of high-frequency signal jumping of electronic products. As for a liquid crystal display, there are mainly two causes leading to the production of EMI: 1. high-frequency switch of switching power supply; and 2. high-frequency data transmission.

SUMMARY

According to the above problem existing in the prior art, it is an object of the present disclosure to propose a display device and a driving method so as to solve the problem of electromagnetic interference caused by high-frequency data transmission.

Based on the above object, a display device is provided in the present disclosure, which includes: a timing controller used to generate a timing control verification signal based on a display data signal, wherein the timing controller transmits the display data signal to a driver via a high-speed interface, and transmits the timing control verification signal to the driver via a low-speed interface; a drive circuit connected to the timing controller and used to generate a source driving verification signal based on the display data signal from the timing controller, wherein the drive circuit compares the source driving verification signal with the timing control verification signal from the timing controller, and triggers the timing controller to adjust the display data signal based on a result of the comparison; and a display panel connected to the drive circuit, wherein the display data signal adjusted by the timing controller is output to the display panel via the drive circuit for display.

Based on the above object, a driving method of a display device is provided in the present disclosure, which includes: generating, via a timing controller, a timing control verification signal based on a display data signal; transmitting the display data signal to a driver via a high-speed interface of the timing controller, and transmitting the timing control verification signal to the driver via a low-speed interface of the timing controller; generating, via the driver, a source driving verification signal based on the display data signal; comparing the source driving verification signal with the timing control verification signal via the driver; and triggering, via the driver, the timing controller to adjust the display data signal based on a result of the comparison.

Based on the above object, a driving method of a display device is provided in the present disclosure, which includes the following steps of: minimizing an amplitude of a display data signal via a timing controller; generating, via the timing controller, a timing control verification signal based on the display data signal; transmitting the display data signal to a driver via a high-speed interface of the timing controller, and transmitting the timing control verification signal to the driver via a low-speed interface of the timing controller; generating, via the driver, a source driving verification signal based on the display data signal; and comparing whether the source driving verification signal is equal to the timing control verification signal via the driver; and if so, triggering, via the driver, the timing controller to record the display data signal to be output to a display panel; or if not, triggering, via the driver, the timing controller to increase the amplitude of the display data signal, and proceeding to the step of generating, via the timing controller, the timing control verification signal based on the display data signal.

The present disclosure provides a display device and driving method. The display device includes a timing controller, a driver, and a display panel. The driver is connected to the timing controller and the display panel respectively. The timing controller sends a display data signal and a timing control verification signal to the driver. The driver generates a source driving verification signal based on the display data signal. Moreover, the driver compares the source driving verification signal with the timing control verification signal from the timing controller, and triggers the timing controller to adjust the display data signal based on a result of the comparison. When the source driving verification signal is equal to the timing control verification signal, the driver triggers the timing controller to record the display data signal, and sends the recorded display data signal to the display panel for display. With an addition of the verification mechanism, the display device is capable of minimizing the amplitude of data signals to reduce electromagnetic interference while ensuring an accuracy of data transmission.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

Figure 1:
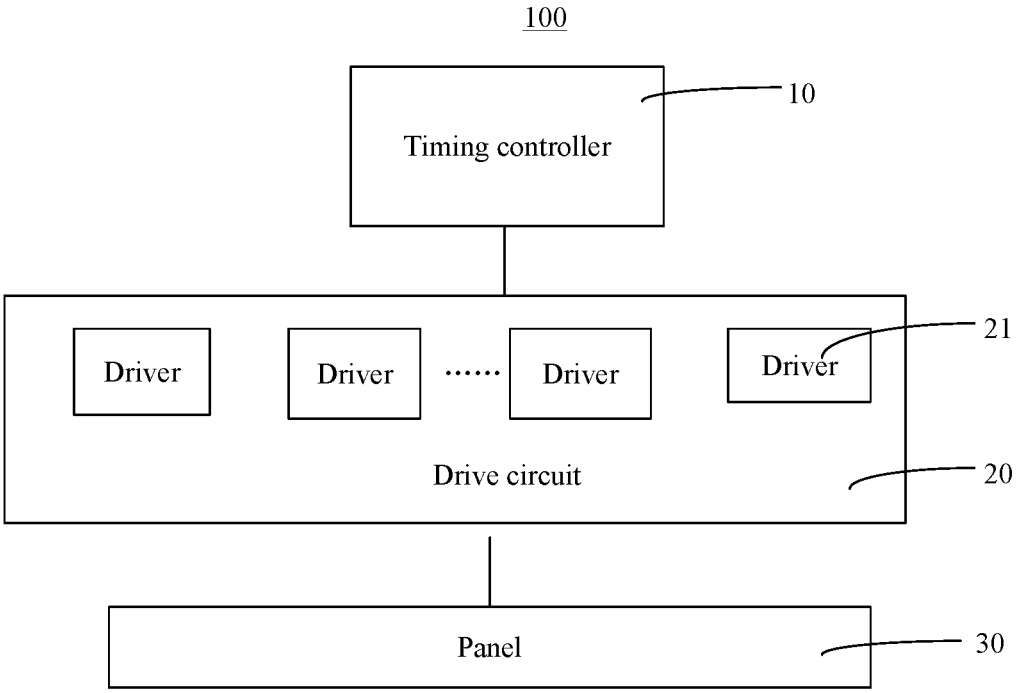
FIG. 1 is a schematic diagram of a display panel and a peripheral circuit of a display device in accordance with an embodiment of the present disclosure.

REFERENCE NUMERALS OF PRIMARY ELEMENTS display device 100
timing controller 10
analyzing and processing module 11
receiving unit 12
output unit 13
high-speed interface 131
low-speed interface 132
drive circuit 20
driver 21
logic gate 22
converter 23
determiner 24
trigger 25
display panel 30

DETAILED DESCRIPTION OF THE EMBODIMENTS

The technical solutions of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

Figure 2:
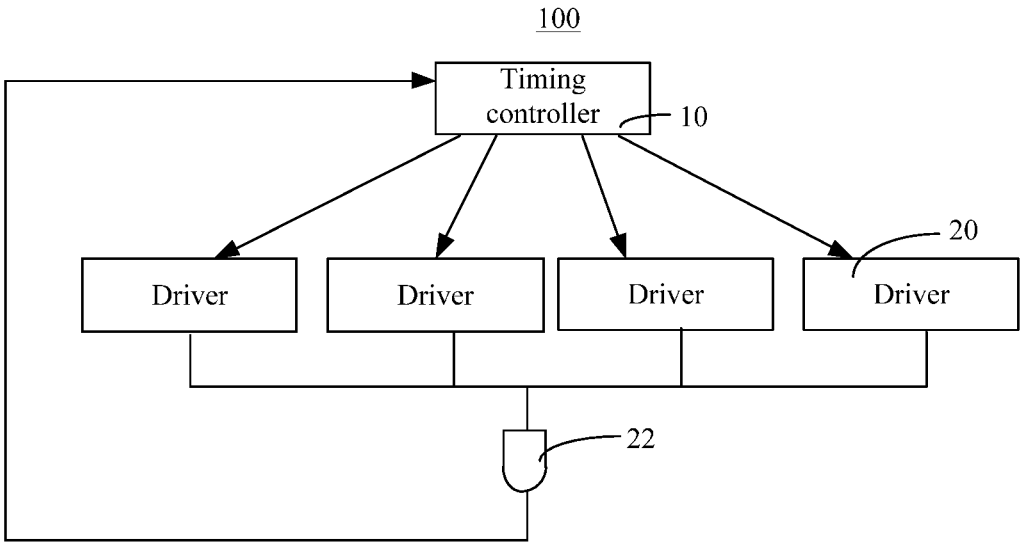
FIG. 2 is a schematic diagram of a timing controller and a drive circuit of a display device in accordance with an embodiment of the present disclosure.

Referring to FIG. 1, it is a schematic diagram of a display panel 30 and a peripheral circuit of a display device 100 of the present disclosure. FIG. 2 is a schematic diagram of a timing controller and a drive circuit 20 of the display device 100 of the present disclosure. As shown in the figures, the display device 100 includes a display panel 30 and a peripheral circuit surrounding the display panel 30. The display panel 30 can include a display area and a non-display area surrounding the display area.

The peripheral circuit can include: a control board (C/B), which is generally a packaged printed circuit board assembly (PCBA) arranged primarily with a timing controller (T-CON) 10 for providing control signals and display data for the display panel 30; a source-chip on film (S-COF) package, which is a chip on film (COF) packaged flexible circuit board, with a source driver (S/D) 21 being the primary chip thereon; a gate-chip on film (G-COF) package, which is a chip on film packaged flexible circuit board, with a gate on array (GOA) driver 21 being the primary chip thereon (actually, no separate GOA driver 21 can be found on some gate drive circuits 20 disposed on the array substrate); circuit boards XL and XR, which are, respectively, two packaged printed circuit board assemblies used to connect the control board C/B and the source-chip on film S-COF; and a flexible flat cable (FFC) used to connect the control board C/B and the circuit board XL or XR, etc. Actually, as for some products, the control board C/B and the circuit board XL or XR can be combined together, such that there is no separate control board C/B, and no flexible flat cable is required.

The timing controller 10 on the control board C/B transmits data via an FFC-X/B-COF-S/D path in a format of miniature-low voltage differential signaling (Mini-LVDS) or in a format of some point to point (P2P) transmission such as universal serial interface (USI-T), image signal processing (ISP), etc. In order to reduce the number of pins for transmission, this transmission path is generally featured by a high transmission frequency (generally, about 300 MHz according to the Mini-LVDS protocol). As such, it is susceptible to the problem of electromagnetic interference. In order to solve this EMI issue, a conventional approach is to reduce an amplitude of Mini-LVDS signals. However, the reduction in the amplitude of signals is prone to lead to the situation in which the source driver 21 cannot receive correct display data. With an addition of verification mechanism, the present disclosure is capable of minimizing the amplitude of data signals to reduce electromagnetic interference while ensuring an accuracy of data transmission.

Referring to FIG. 2, it is a schematic diagram of a timing controller and a drive circuit 20 of the display device 100 of the present disclosure. As shown in the figure, the display device 100 includes a timing controller 10 and a source driver 21.

In this embodiment, alternatively, the timing controller 10 can minimize an amplitude of a display data signal before outputting the display data signal to the source driver 21. The timing controller 10 is provided with a signal receiving unit 12 for receiving the display data signal, an analyzing and processing module 11 and a signal output unit 13 for outputting an analyzed signal. The amplitude of the display data signal is minimized in the analyzing and processing module 11 via an operation method consisting of a least square method, a gradient descent method, etc. After analyzed by the analyzing and processing module 11, the display data signal is output through the signal output unit 13.

Thereafter, or firstly, the timing controller 10 generates a timing control verification signal based on the display data signal; then, the timing controller 10 transmits the display data signal to the source driver 21 via a high-speed interface 131, and transmits the timing control verification signal to the source driver 21 via a low-speed interface 132. Since transmission speeds of the interfaces employed for the display data signal and the timing control verification signal are different, when the timing controller 10 outputs the display data signal and the timing control verification signal at an identical time point, the display data signal will reach the source driver 21 earlier than the timing control verification signal, such that the source driver 21 can respectively process the display data signal and the timing control verification signal in sequence. However, while adoption of high-frequency data transmission may render the display data signal susceptible to electromagnetic interference, in this disclosure, the display data signal will be verified and properly adjusted after its transmission.

Then, the source driver 21 is connected to the timing controller 10, and generates a source driving verification signal based on the display data signal from the timing controller 10. Thereafter, the source driver 21 compares the source driving verification signal with the timing control verification signal from the timing controller 10. If the source driving verification signal generated by the source driver 21 is equal to the timing control verification signal from the timing controller 10, the source driver 21 triggers the timing controller 10 to directly record the current display data signal. However, if the source driving verification signal generated by the source driver 21 is not equal to the timing control verification signal from the timing controller 10, the source driver 21 triggers the timing controller 10 to adjust (e.g., increase) feature (e.g., amplitude) of the display data signal, until the source driving verification signal is equal to the timing control verification signal. At this point, the source driver 21 stops triggering the timing controller 10 to adjust the display data signal; rather, it will trigger the timing controller 10 to record the current adjusted display data signal. In other words, the adjustment will not stop until the amplitude of the display data signal is minimized to reduce the possibility of electromagnetic interference under the conditions of ensuring the accuracy of data transmission.

In this embodiment, alternatively, in the case that there are a plurality of source drivers 21, the drive circuit 20 can also include a logic gate 22 connected between the timing controller 10 and the source drivers 21. After comparing the source driving verification signal with the timing control verification signal, each of the source drivers 21 outputs a corresponding source driving verification signal to the logic gate 22; then, the logic gate 22 triggers the timing controller 10 to adjust the display data signal based on a plurality of source driving verification signals from the plurality of source drivers 21. Furthermore, the drive circuit 20 can include a plurality of source drivers 21. In this embodiment, the case in which there are four source drivers 21 is given as an example, but this is not limiting. Actually, there can be one or more source drivers 21 and an appropriate number of logic gates 22.

For example, the logic gate 22 is an AND gate, which is connected between an output terminal of the source driver 21 and an input terminal of the timing controller 10. Outputs of the four source drivers 21 as shown in FIG. 2, which are taken as inputs of the AND gate, are, respectively, locked value 1, locked value 2, locked value 3, and locked value 4, and an output of the AND gate is as follows: locked value=(locked value 1)×(locked value 2)×(locked value 3)×(locked value 4). When comparison made by each source driver 21 indicates that the source driving verification signal is not equal to the timing control verification signal from the timing controller 10, the source driver 21 outputs a low-level source driving verification signal to the AND gate. Conversely, when comparison made by each source driver 21 indicates that the source driving verification signal is equal to the timing control verification signal, the source driver 21 outputs a high-level source driving verification signal to the AND gate. Thereafter, when at least one of a plurality of source driving verification signals from a plurality of source drivers 21 is at a low level (namely, when the locked value=(locked value 1=0)×(locked value 2)×(locked value 3)×(locked value 4)=0×1×1×1=0)), the AND gate outputs a low-level signal to the timing controller 10, to trigger the timing controller 10 to increase the amplitude of the display data signal (the timing controller 10 can be predetermined to be triggered at a low level to increase the amplitude of the display data signal). In other words, when a plurality of source driving verification signals from a plurality of source drivers 21 are all at a high level (namely, when (locked value 1)×(locked value 2)×(locked value 3)×(locked value 4)=1×1×1×1=1), the AND gate outputs a high-level signal to the timing controller 10, to trigger the timing controller 10 to record the display data signal.

Alternatively, for example, the logic gate 22 is an OR gate. In this case, when comparison made by each source driver 21 indicates that the source driving verification signal is not equal to the timing control verification signal from the timing controller 10, the source driver 21 outputs a high-level source driving verification signal to the OR gate; conversely, when the comparison indicates that they are equal, a low-level source driving verification signal is output to the OR gate. Thereafter, when at least one of a plurality of source driving verification signals from a plurality of source drivers 21 is at a high level, the OR gate outputs a high-level signal to the timing controller 10, to trigger the timing controller 10 to increase the amplitude of the display data signal (the timing controller 10 can be predetermined to be triggered at a high level to increase the amplitude of the display data signal). In other words, when a plurality of source driving verification signals from a plurality of source drivers 21 are all at a low level, the OR gate outputs a low-level signal to the timing controller 10. In this case, the display data signal is recorded directly without adjusting the amplitude of the display data signal.

Figure 3:
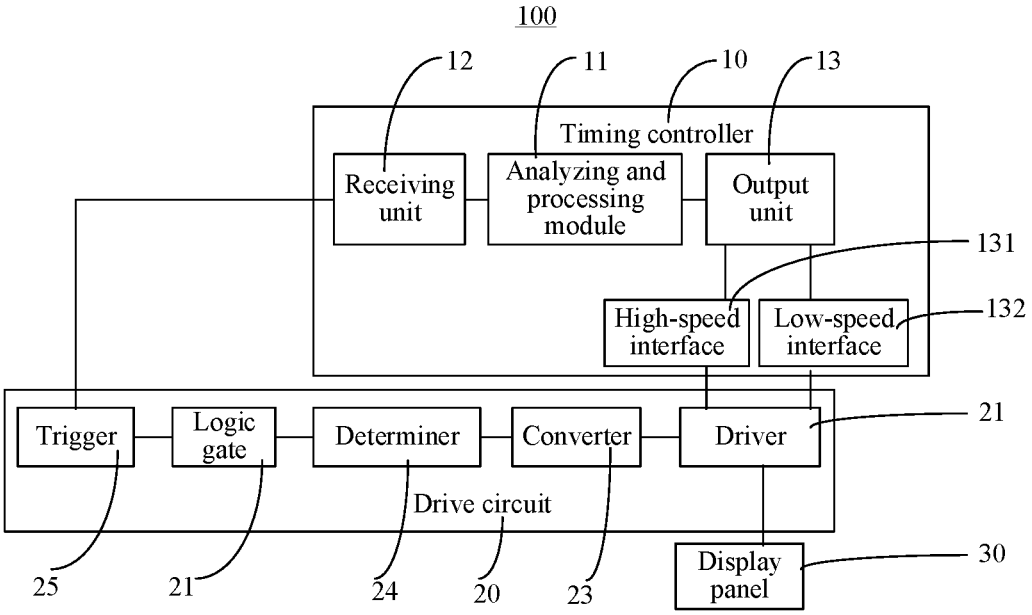
FIG. 3 is a schematic diagram of a timing controller and a drive circuit of a display device provided in an embodiment of the present disclosure.

Referring to FIG. 3, the drive circuit 20 further includes a converter 23, a determiner 24, and a trigger 25.

The converter 23 is communicably connected to the high-speed interface and the low-speed interface of the output unit 13, respectively. The converter 23 generates a source driving verification signal based on the display data signal from the timing controller 10. The determiner 24 is communicably connected to the logic gate 22 and the converter 23, respectively. The determiner 24 compares whether the source driving verification signal is equal to the timing control verification signal from the timing controller 10. The trigger 25 is disposed between the determiner 24 and the receiving unit 12. The trigger 25 can send a high-level or low-level signal to the receiving unit 12 based on a determining result. Based on the signal sent by the trigger, the analyzing and processing module 11 adjusts the amplitude of the display data signal, or records the display data signal and sends it to the display panel 30 for display via the driver 21.

Eventually, referring to FIG. 1 again, the display data signal adjusted by the control board C/B (including the timing controller 10) can be output to the display panel 30 via the source-chip on film (S-COF) (including the source driver 21), such that the display panel 30 performs displaying based on the adjusted display data signal.

Figure 4:
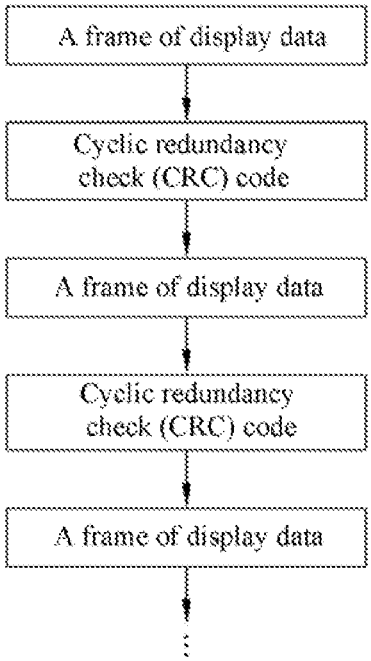
FIG. 4 is a schematic diagram of a verification means of a driving method of a display device in accordance with an embodiment of the present disclosure.

Referring to FIG. 4, it is a schematic diagram of a verification means of the driving method of the display device 100 according to an embodiment of the present disclosure. The timing control verification signal and the source driving verification signal generated respectively by the above-mentioned timing controller 10 and the source driver 21 based on the display data signal can each include cyclic redundancy check (CRC) code corresponding to one another. As shown in FIG. 4, listed is an example of relationship between the display data and the CRC data sent by the timing controller 10. In other words, the timing controller 10 (see FIG. 2) calculates CRC code once per frame, and sends them to the source driver 21 (see FIG. 2); meanwhile, the source driver 21 also calculates CRC code once per frame.

Figure 5:
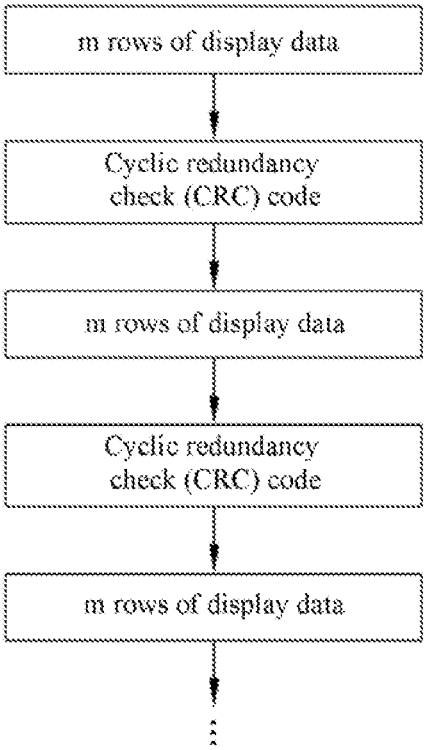
FIG. 5 is a schematic diagram of a verification means of a driving method of a display device in accordance with another embodiment of the present disclosure.

Referring to FIG. 5, it is a schematic diagram of the verification means of the driving method of the display device 100 according to another embodiment of the present disclosure. The timing control verification signal and the source driving verification signal generated respectively by the above-mentioned timing controller 10 and the source driver 21 based on the display data signal can each include cyclic redundancy check (CRC) code corresponding to one another. Unlike FIG. 4, in the embodiment of FIG. 5, listed is another example of the relationship between the display data and the CRC data sent by the timing controller 10. In other words, the timing controller 10 (see FIG. 2) calculates CRC code once per m rows, and sends them to the source driver 21 (see FIG. 2); meanwhile, the source driver 21 also calculates CRC code once per m rows.

Figure 6:
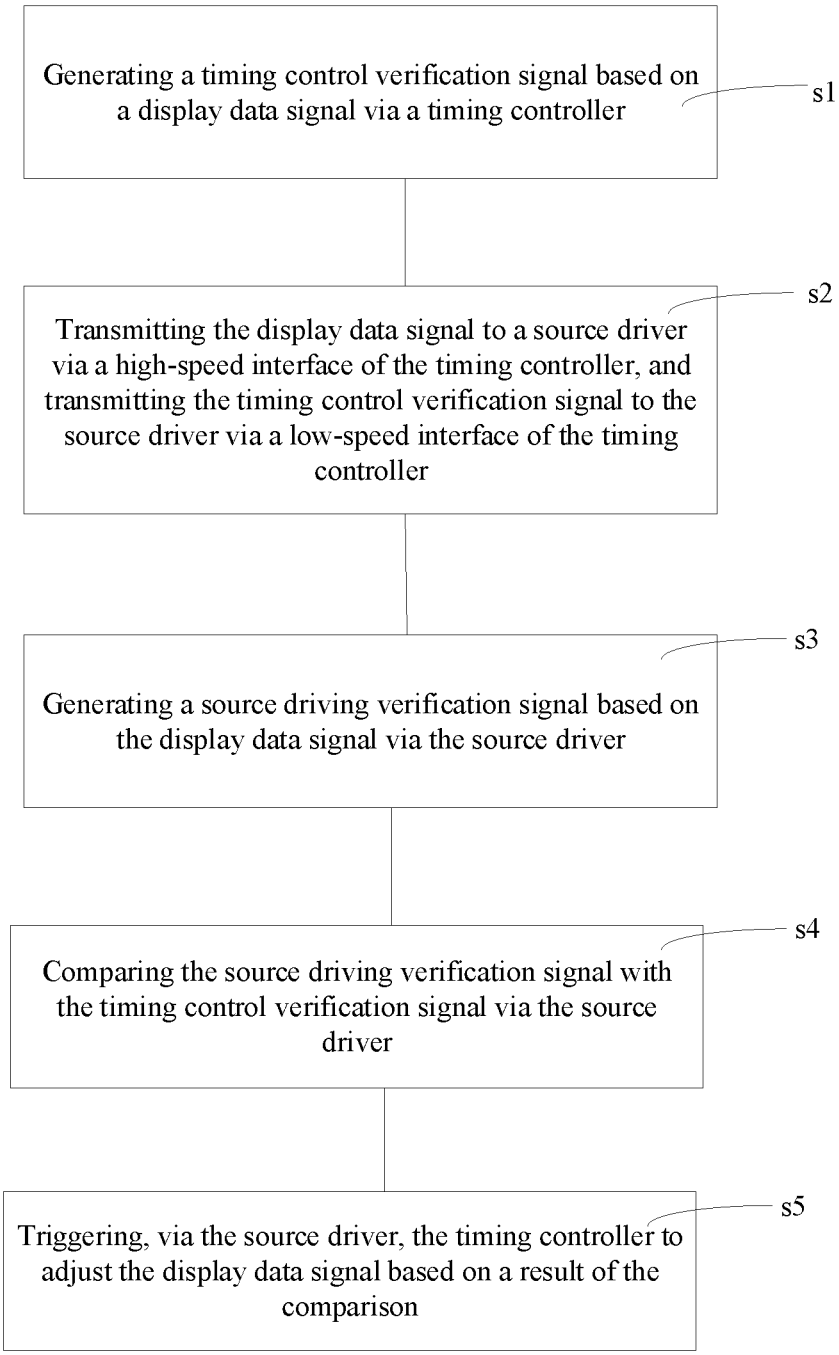
FIG. 6 is a flow chart of a driving method of a display device in accordance with an embodiment of the present disclosure.

Referring to FIG. 6, it is a flow chart of the driving method of the display device 100 according to an embodiment of the present disclosure. As shown in FIG. 6, the driving method of the display device 100 can include the following steps s1 to s5.

In step s1, a timing control verification signal is generated based on a display data signal via a timing controller 10.

In step s2, the display data signal is transmitted to a source driver 21 via a high-speed interface 131 of the timing controller 10, and the timing control verification signal is transmitted to the source driver 21 via a low-speed interface 132 of the timing controller 10.

In step s3, a source driving verification signal is generated based on the display data signal by the source driver 21.

In step s4, the source driving verification signal is compared with the timing control verification signal by the source driver 21.

In step s5, the timing controller 10 is triggered by the source driver 21 to adjust the display data signal based on a result of the comparison.

In this embodiment, alternatively, the driving method of the display device 100 also includes: minimizing, by the timing controller 10, an amplitude of the display data signal before outputting it the source driver 21. The timing controller 10 is provided with a signal receiving unit 12 for receiving the display data signal, an analyzing and processing module 11, and a signal output unit 13 for outputting an analyzed signal. The amplitude of the display data signal is minimized in the analyzing and processing module 11 through an operation method consisting of a least square method, a gradient descent method, etc. After analyzed by the analyzing and processing module 11, the display data signal is output through the signal output unit 13. The timing controller 10 is triggered by the source driver 21 to increase the amplitude of the display data signal when comparison made by the source driver 21 indicates that the source driving verification signal is not equal to the timing control verification signal from the timing controller 10.

In this embodiment, alternatively, the driving method further includes: outputting a corresponding source driving verification signal to a logic gate 22 after comparing the source driving verification signal with the timing control verification signal through a plurality of source drivers 21; and triggering, via the logic gate 22, the timing controller 10 to adjust the display data signal based on a plurality of source driving verification signals from a plurality of source drivers 21.

In this embodiment, alternatively, the driving method of the display device 100 further includes triggering, by the source driver 21, the timing controller 10 to record the display data signal when comparison made by the source driver 21 indicates that the source driving verification signal is equal to the timing control verification signal from the timing controller 10.

With the above-mentioned steps, the electromagnetic interference caused by high-frequency transmission of display data can be avoided.

Figure 7:
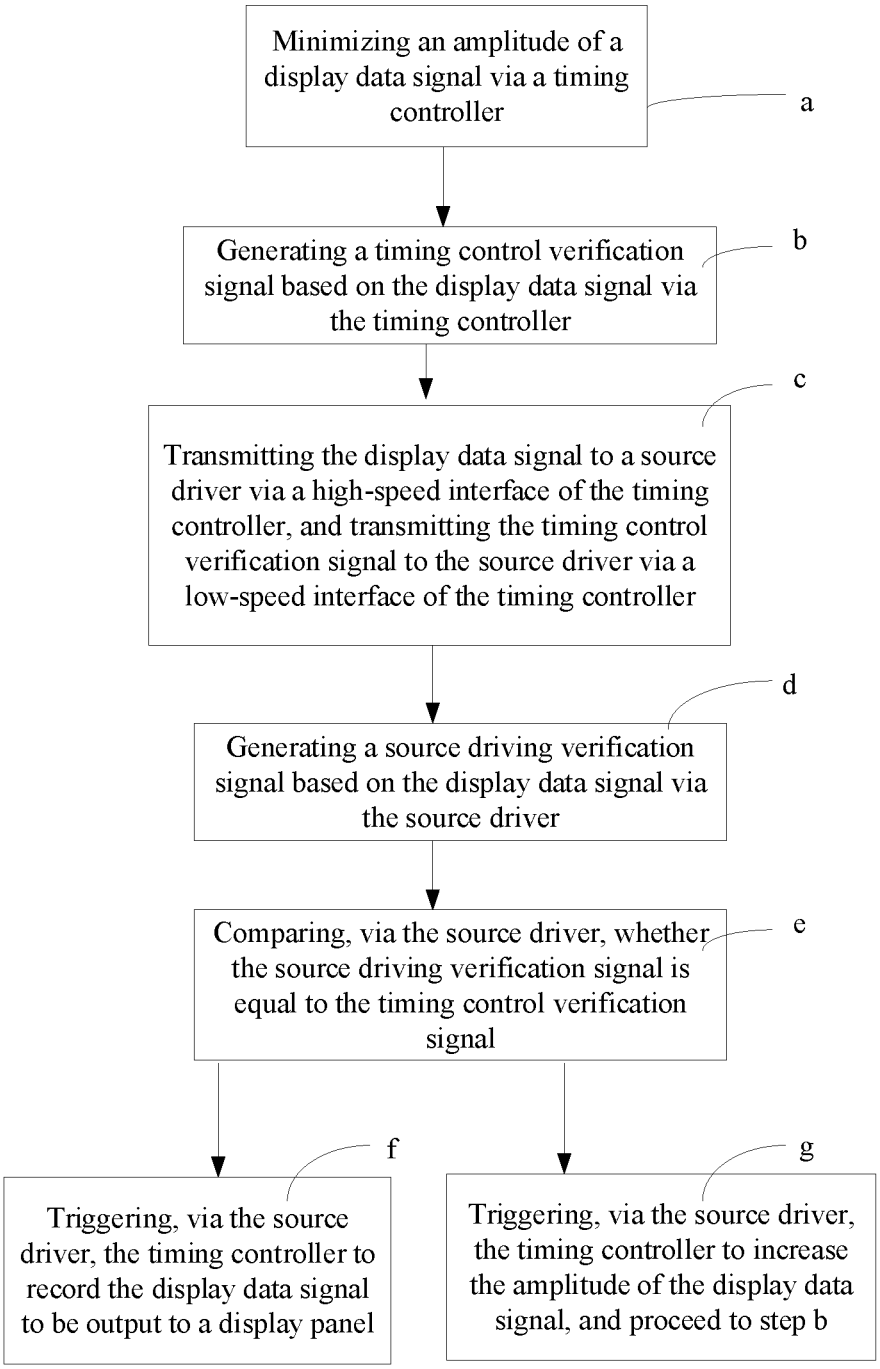
FIG. 7 is a flow chart of a driving method of a display device in accordance with another embodiment of the present disclosure.

FIG. 7 is a flow chart of a driving method of a display device 100 according to another embodiment of the present disclosure. As shown in FIG. 7, the driving method of the display device 100 can include the following steps a to g.

In step a, an amplitude of a display data signal is minimized via a timing controller 10.

In step b, a timing control verification signal is generated by the timing controller 10 based on the display data signal;

In step c, the display data signal is transmitted to a source driver 21 via a high-speed interface 131 of the timing controller 10, and the timing control verification signal is transmitted to the source driver 21 via a low-speed interface 132 of the timing controller 10.

In step d, a source driving verification signal is generated by the source driver 21 based on the display data signal.

In step e, whether the source driving verification signal is equal to the timing control verification signal is compared by the source driver 21; and if so, the following step f is performed; or if not, the following step g is performed.

In step f, the timing controller 10 is triggered by the source driver 21 to record the display data signal to be output to a display panel 30.

In step g, the timing controller 10 is triggered by the source driver 21 to increase the amplitude of the display data signal, and proceeding to the Step b.

With the above-mentioned steps, the electromagnetic interference caused by high-frequency transmission of display data can be avoided.

It should be noted that in the foregoing embodiments, the description of each embodiment has respective focuses. For a part that is not described in detail in an embodiment, reference can be made to related descriptions in other embodiments.

The foregoing descriptions are merely specific embodiments of this application, but are not intended to limit the protection scope of this application. Any modification or replacement readily figured out by persons skilled in the art within the technical scope disclosed in this application shall fall within the protection scope of this application. Therefore, the protection scope of this application shall be subject to the appended claims.

Finally, it should be noted that the relational terms herein such as first and second are used only to differentiate an entity or operation from another entity or operation, and do not require or imply any actual relationship or sequence between these entities or operations. And, the terms "include", "contain" and any other variants are intended to cover the non-exclusive inclusion. Thereby, the process, method, article, or device which include a series of elements not only include those elements, but also include other elements which are not clearly listed, or include the inherent elements of the process, method, article and device. Without further limitation, the element defined by a phrase "include one . . . " does not exclude other same elements in the process, method, article or device which include the element.

It should be noted that the embodiments in this specification are all described in a progressive manner. Description of each of the embodiments focuses on differences from other embodiments, and reference can be made to each other for the same or similar parts among respective embodiments.

The above description of the disclosed embodiments enables persons skilled in the art to implement or use this application. Various modifications to these embodiments are obvious to persons skilled in the art, the general principles defined herein can be implemented in other embodiments without departing from the spirit and scope of this application. Therefore, this application is not limited to these embodiments illustrated herein, but needs to conform to the broadest scope consistent with the principles and novel features disclosed herein.

What is claimed is:

1. A display device, comprising:

a timing controller configured to generate a timing control verification signal based on a display data signal;

a drive circuit connected to the timing controller and configured to generate a source driving verification signal based on the display data signal from the timing controller, wherein the drive circuit compares the source driving verification signal with the timing control verification signal, and triggers the timing controller to adjust the display data signal based on a result of the comparison; and a display panel connected to the drive circuit, wherein the display data signal adjusted by the timing controller is output to the display panel via the drive circuit for display, wherein the drive circuit further comprises:

a plurality of drivers; and a logic gate connected between the timing controller and each driver, wherein each of the drivers outputs a corresponding source driving verification signal to the logic gate after comparing the source driving verification signal with the timing control verification signal, and the logic gate triggers the timing controller to adjust the display data signal based on the plurality of source driving verification signals from the plurality of drivers.

2. The display device according to claim 1, wherein the logic gate is an AND gate, wherein each of the drivers outputs a low-level source driving verification signal to the logic gate when the result of the comparison made by each of the drivers indicates that the source driving verification signal is not equal to the timing control verification signal, or each of the drivers outputs a high-level source driving verification signal to the logic gate when the result of the comparison made by each of the drivers indicates that the source driving verification signal is equal to the timing control verification signal, and the logic gate triggers the timing controller to adjust the display data signal when at least one of the plurality of source driving verification signals from the plurality of drivers is at a low level.

3. The display device according to claim 1, wherein the logic gate is an OR gate, wherein each of the drivers outputs a low-level source driving verification signal to the OR gate when the result of the comparison made by each of the drivers indicates that the source driving verification signal is not equal to the timing control verification signal, or each of the drivers outputs a high-level source driving verification signal to the OR gate when the result of the comparison made by each of the drivers indicates that the source driving verification signal is equal to the timing control verification signal, and the OR gate triggers the timing controller to adjust the display data signal when the plurality of source driving verification signals from the plurality of drivers are all at a low level.

4. The display device according to claim 1, wherein the timing controller comprises:

one or more circuits arranged into an analyzing and processing module, wherein the analyzing and processing module is configured to minimize an amplitude of the display data signal before outputting the display data signal to the drive circuit, wherein the drive circuit triggers the timing controller to increase the amplitude of the display data signal when the result of the comparison made by the drive circuit indicates that the source driving verification signal is not equal to the timing control verification signal from the timing controller.

5. The display device according to claim 4, wherein the timing controller further comprises:

one or more circuits arranged into a receiving unit, wherein the receiving unit is connected to the analyzing and processing module, and configured to receive the display data signal and send the display data signal to the analyzing and processing module.

6. The display device according to claim 4, wherein the timing controller further comprises:

one or more circuits arranged into an output unit, wherein the output unit is respectively connected to the analyzing and processing module and the drive circuit, and configured to send a signal processed by the analyzing and processing module to the drive circuit.

7. The display device according to claim 6, wherein the output unit comprises:

a high-speed interface connected to the drive circuit, wherein the timing controller transmits the display data signal to the drive circuit via the high-speed interface.

8. The display device according to claim 7, wherein the output unit further comprises:

a low-speed interface connected to the drive circuit, wherein the timing controller transmits the timing control verification signal to the drive circuit via the low-speed interface.

9. The display device according to claim 1, wherein the drive circuit further comprises:

one or more circuits arranged into a converter, wherein the converter is connected to the timing controller and configured to generate the source driving verification signal based on the display data signal from the timing controller.

10. The display device according to claim 9, wherein the drive circuit further comprises:

one or more circuits arranged into a determiner, wherein the determiner is connected to the converter and configured to compare whether the source driving verification signal is equal to the timing control verification signal from the timing controller.

11. The display device according to claim 10, wherein the drive circuit further comprises:

one or more circuits arranged into a trigger, wherein the trigger is connected to the determiner and configured to trigger the timing controller to record the display data signal when the determiner determines that the source driving verification signal is equal to the timing control verification signal from the timing controller.

12. A driving method of a display device, comprising:

generating, via a timing controller, a timing control verification signal based on a display data signal;

transmitting the display data signal to a driver via a high-speed interface, and transmitting the timing control verification signal to the driver via a low-speed interface;

generating, via the driver, a source driving verification signal based on the display data signal;

comparing, via the driver, the source driving verification signal with the timing control verification signal;

triggering, via the driver, the timing controller to adjust the display data signal based on a result of the comparison; and outputting a corresponding source driving verification signal to a logic gate after comparing the source driving verification signal with the timing control verification signal via a plurality of drivers.

13. The driving method of the display device according to claim 12, further comprising:

minimizing, via the timing controller, an amplitude of the display data signal before outputting the display data signal to the driver.

14. The driving method of the display device according to claim 12, further comprising:

triggering, via the driver, the timing controller to increase the amplitude of the display data signal when the result of the comparison made by the driver indicates that the source driving verification signal is not equal to the timing control verification signal from the timing controller.

15. The driving method of the display device according to claim 12, further comprising:

triggering, via the driver, the timing controller to record the current display data signal when the result of the comparison made by the driver indicates that the source driving verification signal is equal to the timing control verification signal from the timing controller.

16. The driving method of the display device according to claim 12, further comprising:

triggering, via the logic gate, the timing controller to adjust the display data signal based on the plurality of source driving verification signals from the plurality of drivers.

17. The driving method of the display device according to claim 12, further comprising:

outputting the corresponding source driving verification signal to the logic gate after comparing the source driving verification signal with the timing control verification signal via the plurality of drivers, wherein when signals received by the logic gate are all at a high level, the logic gate outputs a high-level signal to the timing controller, to trigger the timing controller to record the display data signal; and when at least one signal received by the logic gate is at a low level, the logic gate outputs a low-level signal to the timing controller, to trigger the timing controller to increase the amplitude of the display data signal.

18. A driving method of a display device, comprising:

minimizing an amplitude of a display data signal via a timing controller;

generating, via the timing controller, a timing control verification signal based on the display data signal;

transmitting the display data signal to the driver via the high-speed interface, and transmitting the timing control verification signal to the driver via the low-speed interface;

generating, via the driver, a source driving verification signal based on the display data signal; and comparing whether the source driving verification signal is equal to the timing control verification signal via the driver; and if so, triggering, via the driver, the timing controller to record the display data signal to be output to a display panel; or if not, triggering, via the driver, the timing controller to increase the amplitude of the display data signal, and proceeding to the step of generating, via the timing controller, a timing control verification signal based on the display data signal, wherein a corresponding source driving verification signal is output to a logic gate after comparing the source driving verification signal with the timing control verification signal via a plurality of drivers.

* * * * *